United States Patent [19]

Leathers et al.

[11] Patent Number: 4,806,263

[45] Date of Patent: Feb. 21, 1989

[54] FUNGICIDAL AND ALGICIDAL DETERGENT COMPOSITIONS

[75] Inventors: Amy Z. Leathers, Allison Park; S. Thomas Greer, Oakmont, both of Pa.

[73] Assignee: PPG Industries, Inc., Pittsburgh, Pa.

[21] Appl. No.: 46,748

[22] Filed: May 7, 1987

Related U.S. Application Data

[63] Continuation-in-part of Ser. No. 815,493, Jan. 2, 1986, abandoned.

[51] Int. Cl.[4] ..... C11D 3/48; C11D 7/54

[52] U.S. Cl. ..... 252/106; 252/90; 252/95; 252/173; 252/186.1; 252/187.21; 252/187.23; 252/DIG. 14; 134/2; 134/42

[58] Field of Search ..... 252/95, 106, 173, DIG. 14, 252/90, 92, 107, 174, 173, 187.22, 187.23, 187.24, 187.25, 187.26, 187.27, 187.31, 187.32, 187.33, 187.34; 514/383; 134/2, 42

[56] References Cited

U.S. PATENT DOCUMENTS

| | | | |
|---|---|---|---|
| 3,580,853 | 5/1971 | Parran | 252/DIG. 14 |
| 3,823,094 | 7/1974 | Lancz | 252/DIG. 14 |
| 3,875,071 | 4/1975 | Grand | 252/106 |
| 4,028,261 | 6/1977 | Peterson et al. | 252/89 R |
| 4,097,395 | 6/1978 | Posey et al. | 252/DIG. 14 |
| 4,164,477 | 8/1979 | Whitley | 252/106 |
| 4,201,764 | 5/1980 | French et al. | 514/736 |
| 4,217,129 | 8/1980 | Shephard et al. | 514/383 |
| 4,271,030 | 6/1981 | Brierley et al. | 252/95 |
| 4,323,602 | 4/1982 | Parker | 514/478 |
| 4,339,235 | 6/1982 | Anderson | 252/95 |
| 4,388,204 | 6/1983 | Dimond et al. | 252/99 |
| 4,575,500 | 3/1986 | Burg et al. | 514/121 |

OTHER PUBLICATIONS

Troysan Polyphase WD-17, Troy Chemical, Mar. 31, 1984.

Troysan Polyphase P100, Troy Chemical, Jun. 1985.

Mildew Check (TM) House Wash, R. F. Wilkinson, 02-08-88.

Pittsburgh Paints, Survey Results, Creamer Dickson Basford, 03-16-88.

Formulation of AMICAL in Mineral Spirits, Abbott Laboratories, 02-28-77.

AMICAL 50: An Effective Mildewaide/Algicide for Protection of Roof Coatings, No. 7, Abbott Laboratories, Pre 01-86.

AMICAL 48, Bulletin #75-1-86, Abbott Laboratories, 01-86.

Busan 1009, D23W, Buckman Laboratories, Inc., 06-3-0-82.

Busan 1009 for Wood-protective Coatings, Buckman Laboratories, Inc., 05-82.

Preventol A4-S, Mobay, 01-11-82.

Preventol A4, Material Safety Data Sheet, Mobay, 05-05-83.

Preventol A3, Preventol A4—Potential Active Ingredients for Antifouling paints, product—Information, Bayer, 01-11-82.

Preventol A4 WP 50, Bayer Material Protection, Pre 01-86.

Preventol for Mould-resistant Surface Coatings, Mould Resistant Test, Bayer AG, Pre 01-86.

AMICAL Flowable, Technical Information, Abbott Laboratories, Pre 01-86.

Cosan P, Cosan Chemical Corp., Pre 01-86.

Cosan P, Material Safety Data Sheet, Cosan Chemical Corp., 06-27-83.

*Primary Examiner*—Paul Lieberman

*Assistant Examiner*—Hoa Van Le

*Attorney, Agent, or Firm*—Thomas M. Breininger

[57] ABSTRACT

A non-film forming, aqueous composition is disclosed for cleaning and for killing and inhibiting the regrowth of fungi and algae on a solid surface. The composition comprises a water-insoluble compound selected from the group consisting of a fungicide, an algicide and a mixture thereof dispersed in the composition; a detergent, a thickener, an oxidizing agent and water. Also disclosed is the composition in a two package form in which the oxidizing agent and at least a portion of the water are in one package, and the fungicide, algicide or mixture thereof, the detergent, the thickener, and optionally a portion of the water are in another package.

Also disclosed is a process for cleaning a solid surface with the aqueous composition.

10 Claims, No Drawings

FUNGICIDAL AND ALGICIDAL DETERGENT COMPOSITIONS

This is a continuation-in-part of application Ser. No. 815,493, filed Jan. 2, 1986, now abandoned.

BACKGROUND OF THE INVENTION

The present invention relates to non film-forming, aqueous, compositions containing a detergent and fungicide and/or algicide for cleaning solid surfaces and destroying and preventing the regrowth of fungi and algae on such surfaces. More particularly, the invention is directed to such compositions additionally containing a thickener and an oxidizing agent.

Fungi, primarily *Aureobasidium pullulans,* are responsible for the mildew growth seen on the exterior painted surfaces of houses, particularly in warm, damp climates. Algae, primarily Chlorophyta and Myxophyceae also appear on such painted surfaces. Fungi, primarily *Aspergillus niger,* are responsible for the mildew growth seen on hard indoor surfaces, such as bathroom tile and grout. Removal of such algae and fungi from hard surfaces, particularly painted surfaces, is a difficult problem. If the fungi and algae are not completely removed from painted surfaces they could reappear at a rate faster than that at which they were observed growing originally. Detergent compositions, as disclosed in U.S. Pats. Nos. 4,097,395 and 4,164,477, are known for cleaning hard surfaces. These compositions contain a fungicide, detergent and organic acid as well as components that function as degreasants, wetting agents, sequestering agent, penetrants and the like. The detergent compositions are diluted with a bleach just prior to application.

Typically, detergent compositions include a plurality of constituents, the basic constituent being a detergent. The term detergent is commonly used, and is used herein, to refer to the constituents of the detergent composition that are responsible for the cleansing action of the detergent composition.

Other constituents of detergent compositions vary depending upon the type of substrate to be cleaned. Detergent compositions for cleaning hard surfaces typically include wetting agents and penetrants as well as chelating and sequestering agents to augment the cleansing action of the detergent.

An object of the invention is to develop a cleaning composition that will clean dirt, fungi and algae from solid surfaces having an improved ability to inhibit the regrowth of the fungi and algae.

SUMMARY OF THE INVENTION

Non-film forming compositions of the invention for cleaning and for killing and inhibiting the regrowth of fungi and algae on a solid surface comprise a water-insoluble compound selected from the group consisting of a fungicide, an algicide and mixtures thereof stably dispersed in the composition, a detergent, a thickener, and a chlorine-generating type of oxidizing agent. By water insoluble, it is meant that the water-insoluble compound has a water solubility of less than 0.1 percent by weight at a temperature of 25° C. Generally, the water-insoluble compound is present at a level of at least about 0.003 percent, by weight, of the composition. Generally, the detergent is present at a level of at least about 1.0 percent, by weight, of the composition.

The preferred water-insoluble compound is 3-iodo-2-propynyl butyl carbamate.

Processes of the invention comprise the steps of applying a composition of the invention to a solid surface and, after the composition has been in contact with the surface for a sufficient length of time to at least partially clean the surface, rinsing the composition from the surface.

DETAILED DESCRIPTION OF THE INVENTION

Non-film forming compositions of the invention include a water-insoluble compound selected from the group consisting of fungicide, an algicide and mixtures thereof. Suitable water-insoluble fungicides and algicides are those that have a water solubility of less than 0.1 percent, by weight, at a temperature of 25° C. Examples of such fungicides include diiodomethyl p-tolyl sulfone available as either Amical® 48 or Amica® 50 from Abbott Laboratories, N-(trichloromethyl thio) phthalimide available as Fungitrol 11 from Nuodex and Cosan P from Cosan Chemical Corporation, N,N-dimethyl-N'-phenyl N'-(fluorodichloromethyl thio) sulphamide available as Preventol A 4-S from Mobay Chemical Company, a 97.5 percent, by weight, solution of imazalil available as Fungaflor from Janssen Pharmaceutica and a mixture of 2-(thiocyanomethylthio) benzothiazole and methylene bis(thiocyanate) available as Busan 1009 from Buckman Laboratories, Inc. The preferred fungicide/algicide is 3-iodo-2-propynyl butyl carbamate available from Troy Chemical Company as Troysan® Polyphase P100 (97% active) and Troysan® Polyphase WD-17 (17% active). Generally, the water-insoluble compound is present at a level of from at least about 0.003 percent, preferably from about 0.1 percent to about 0.4 percent and, more preferably, from about 0.15 percent to about 0.3 percent, by weight of the composition.

The water-insoluble compound is stably dispersed in the aqueous composition of the invention. The preferred method of stably dispersing the water-insoluble compound in the composition involves dispersing the water-insoluble compound in a linear primary alcohol ethoxylate or mixture of such ethoxylates having an average hydrophilic-lipophilic balance of between about 12 and about 16, preferably between about 14 and about 15. Preferably, the composition includes from about 1.5 percent to about 6 percent, by weight, more preferably from about 1.5 percent to about 4 percent, by weight, of the primary alcohol ethoxylate. Such linear primary alcohol ethoxylates are surfactants which, advantageously, also serve as detergents and include a $C_{9-C11}$ linear primary alcohol ethoxylate, which is an ethylene oxide adduct containing 8 moles of ethylene oxide per mole alcohol available from Shell Chemical Company as Neodol® 91-8 and a $C_{12-C15}$ linear primary alcohol ethoxylate which is an ethylene oxide adduct containing 9 moles of ethylene oxide per mole of alcohol available as Neodol® 25-9 . Small amounts, about 0.5-4.0 percent, of a solvent such as xylene, benzyl alcohol or tetrahydrofurfuryl alcohol may be included to help stably disperse the water-insoluble compound in the composition.

A second method to stably disperse the water-insoluble compound in the composition involves preparing an emulsion of the water-insoluble compound in a nonionic ethoxylated alkyl phenol, such as octylphenoxypoly (ethylene oxy) ethanol available as Triton® X-100 from Rohm & Haas Co. and Igepal CA630 from the Chemical Products Division of GAF Corporation, nonylphenoxy (polyethyleneoxy) ethanol available as Triton® X-101 from Rohm & Haas Co. and Igepal CO210 available from the Chemical Products Divison of GAF Corporation and as PolyTergent® B-350 or B-500 available from Olin Corp. Typically, if this method is used to prepare the composition, the composition will include between about 1 and about 3 percent, by weight, of the ethoxylated alkyl phenol. The water-insoluble compound may be mixed with a small amount, about 0.5–4.0 percent, of an organic solvent such as xylene or tetrahydrofurfuryl alcohol prior to forming the emulsion.

Non-film forming compositions of the invention include a detergent. As used herein, the term "detergent" should be taken to mean a material that exhibits "detergency" which term is restricted to cleaning systems in which the following conditions prevail: (1) a liquid bath is present, and is the major cleansing constituent of the system; (2) the action of the bath involves more than a simple dissolving of the soil, although dissolving of some of the soil constituents may occur, and more than a simple hydraulic dislodging of the soil, although some action of this type inevitably occurs; (3) the enhanced cleaning effect is caused primarily by the presence in the bath of a special solute, called the detergent, which acts by altering interfacial effects at the various phase boundaries within the system. It will be appreciated that while all detergents are surface active, not all surface active agents are detergents. Generally, the detergent is present in the composition at a level of at least about 1.0 percent, by weight, of the composition, preferably from about 1.0 percent to 6.0 percent, by weight, of the composition. The primary alcohol ethoxylates and ethoxylated alkyl phenols mentioned above act as detergents in a composition of the invention. Other detergents can be included in the composition of the invention, including alkali salts such as sodium metasilicate, sodium silicate, trisodium phosphate, sodium sesquacarbonate, sodium orthosilicate, soaps such as sodium lauryl sulfate and surfactants which also act as detergents in the composition such as sodium 2–ethylhexyl sulfate.

When adding additional detergents to the composition, it must be kept in mind that the pH of the composition when containing the preferred 3–iodo-2–propynyl butyl carbamate should be less than about 9 so that the 3–iodo-2–propynyl butyl carbamate does not degrade. This, of course, can be achieved by use of either a pH adjuster or a two pack system, keeping the 3–iodo-2–propynyl butyl carbamate in an environment of a pH less than about 9 until the composition is ready for use.

The composition may further include a pH adjuster so that the pH of the composition prior to the addition of the oxidizing agent component is between about 4.0 and about 8.5, preferably between about 6.0 and about 8.5, more preferably between about 5.2 and about 7.0. An advantage of adjusting the pH to between about 6.0 and about 8.5 is that the action of the oxidizing agent is best promoted within that pH range. For compositions of the invention suitable for indoor use for cleaning solid surfaces, for example bathtubs and ceramic tile, it is preferred that a pH adjuster be utilized. One preferred pH adjuster is boric acid. Other suitable pH adjusters include organic aliphatic and aromatic carboxylic acids such as formic acid, acetic acid, propionic acid, n-butyric acid, isobutyric acid and acids such as citric acid and tartaric acid.

Preferably, the pH of the composition of the invention suitable for indoor use for cleaning solid surfaces is buffered at a pH of between about 6.0 and about 8.5 prior to the addition of the oxidizing agent component. The most preferred buffering system for this purpose is sodium tetraborate/boric acid. Other suitable buffering systems include potassium phosphate buffer, sodium phosphate buffer, dipotassium phosphate buffer, monopotassium phosphate buffer, phosphate buffer, citrate buffer, sodium acetate buffer, and any weak acid and its corresponding salt with a pH in the range of from about 6.0 to about 8.5 Typically, the buffer will be present in the composition at a level of from about 3 percent to about 10 percent, preferably from about 4 percent to about 8 percent, by weight, so that the composition, prior to the addition of the oxidizing agent component, is adjusted to and buffered at the desired pH level.

The composition of the invention includes a thickener. The thickener useful in connection with the subject invention may be any one of a number of compounds, examples of which include hydroxypropyl distarch phosphate which is a modified corn starch available as Mirathik 469 from Staley Manufacturing Co., polysaccharide thickeners available as Gelrite® and K1A112 from Kelco Division of Merck Company, Inc., Xanthan Gum, a nonionic polyether polyurethane associative thickener available from Union Carbide Corp. as SCT-270, magnesium aluminum silicate available as Attagel® 40 from Englehard Corporation, Guar gum available from Celanese Company as Uniguar 250, gum ghatti, locust bean gum, gum kardya, gum tragacanth and corn starch derivatives such as a modified pregelatinized waxy maize starch available as Instant Gelex® from Amaizo Corporation and a waxy maize starch available as Instant Polar Gel® C from Amaizo Corp. Preferably, the thickener is present at a level so that the viscosity (determined using a Brookfield viscometer operating at 6 revolutions per minute) of the composition at the time it is to be applied to a solid surface is between about 200 and about 4000 centipoise, preferably between 350 and 950 centipoise, at 25 degrees Celsius. Of the thickeners described above, hydroxypropyl distarch phosphate is preferred.

Preferably, the oxidizing agent is mixed with the other required components of the composition of the invention prior to application of the composition to a surface to be cleaned. An oxidizing agent suitable for a composition of the invention is a chlorine-generating type of oxidizing agent which can provide an amount of chlorine to the composition, calculated as elemental C1, in the range of from 0.17 to 0.50 percent by weight of the composition. Preferably, the oxidizing agent is ordinary household bleach. Typically, the bleach will contain at least 5.25 percent, by weight, of sodium hypochlorite. Therefore, when bleach containing 5.25 percent, by weight, of sodium hypochlorite, is used as the oxidizing agent, the bleach is added to the composition so that the bleach is present at a level of between about 7 and about 20 percent, by weight, more preferably about 15 percent, by weight, of the composition of the invention. In addition to sodium hypochlorite, lithium hypochlorite, calcium hypochlorite, as well as chlorinated trisodium phosphate, chlorine dioxide decahydrate, and sodium dichloro-s-triazinetrione dihydrate can be used as the oxidizing agent.

The composition of the present invention can include a chealating and sequestering agent which serves to sequester any metal ions that can interefere with the efficacy of the detergent. This is particularly a concern when tap water is used to dilute the composition before application to a substrate. The preferred chealating and sequestering agent is ethylene diamine tetraacetic acid commonly available in the form of its alkali metal, particularly sodium or ammonium salt. Other compounds which can be used as the chealating and sequestering agent are alkali metal phosphates, such as sodium tripolyphosphate, trisodium phosphate, tetrasodium pyrophosphate and sodium hexametaphosphate, and the alkali metal and ammonium salts of 1-hydroxyethylidene-1,1-diphosphonic acid. Typically, the chealating and sequestering agent is present in the composition at a level of up to about 1.0 percent, by weight, of the composition.

Other components which can be included in the composition of the invention are scenting oils, defoamers, disinfectants, preservatives and the like.

Suitable scenting oils include pine oil, anise oil, vanilla oil, lemon oil, sesame oil, clove leaf oil, rosemary oil, sandalwood oil and vetiver oil.

Suitable defoamers include those available as Foamaster G defoamer from Diamond Shamrock Chemical Co., Nalco 2301 defoamer from Nalco, Patcote® 500 defoamer from Patco Coatings Products and Drew L475 from Drew Chemical Corporation.

A composition of the invention can be in the form of a one package or a two package composition. Typically, a composition of the invention is in the two package form in which the oxidizing agent and at least a portion of the water are in one package and the fungicide, algicide and mixtures thereof, the detergent, the thickener, and optionally a portion of the water are in another package. typically, water will be incorporated in each package of a two package system.

Processes of the invention include the steps of applying a non-film forming aqueous composition comprising a compound selected from the group consisting of a fungicide, an algicide and mixtures thereof stably dispersed in the composition, a detergent, a thickener and an oxidizing agent to a solid surface and, after the composition has been in contact with the solid surface for a sufficient length of time to at least partially clean the solid surface, rinse the composition from the solid surface.

The compositions of the invention can be used to clean and remove fungi and algae from any one of a number of solid surfaces such as exterior painted surfaces, stone, brick, stucco, interior painted surfaces, tile, ceramics, metal, wood and plastic. As used herein the term "solid" is intended to mean that the density and coherence in the mass of the respective material is such as to enable the material to maintain a fixed form. Thus, for example a solid surface is intended to include the surface of a material such as a painted wood surface or a ceramic tile surface as well as the surface of a material such as fabric utilized in outdoor furniture or tents. The phrase "solid surface" is not intended to refer to the skin of humans or animals. The compositions are particularly useful in cleaning and removing fungi and algae from surfaces of organic films, such as painted surfaces. It should be noted that once a painted surface has been cleaned with a composition of the invention, the surface can be repainted and the composition of the invention will inhibit the regrowth of fungi and algae from the cleaned, old painted surface from coming through to the new paint film.

The composition of the invention can be applied to the affected surface using any one of a number of methods. Preferably, the composition is applied using an applicator such as a garden sprayer, airless paint sprayer, compressor paint sprayer or hand pump sprayer. The composition can also be applied using a sponge or brush.

Typically, after the composition of the invention has been applied to the affected surface, the composition will remain in contact with the surface for between about 10 minutes and about 20 minutes before being rinsed off. If the diluted fungicidal detergent composition remains in contact with the affected surface for an extended period of time, the oxidizing agent can begin to attack the surface itself. This is particularly a concern with painted surfaces.

The following Examples set forth specific embodiments of the instant invention. However, the invention is not to be construed as being limited to these embodiments for there are, of course, numerous possible variations and modifications. All parts and percentages in the Examples as well as throughout the specification are by weight unless otherwise indicated.

EXAMPLE 1

A detergent composition was prepared as follows:

| Component | Parts by Weight (Grams) |
|---|---|
| deionized water | 13,965 |
| sodium tetraborate | 1,260 |
| boric acid | 1,176 |
| 3-iodo-2-propynyl butyl carbamate[1] | 42 |
| $C_9$-$C_{11}$ linear primary alcohol ethoxylate[2] | 420 |
| defoamer[3] | 126 |
| xylene | 147 |
| pine oil[4] | 21 |
| thickener[5] | 693 |

[1]97 percent, by weight, in solvents available from Troy Chemical Company as Troysan Polyphase P100.
[2]ethylene oxide adduct containing 8 moles of ethylene oxide per mole alcohol available from Shell Chemical Company as Neodol® 91-8.
[3]silica in mineral oil available from Drew Chemical Corporation as Drew L475.
[4]available from Glidden as No. 150 pine oil.
[5]modified corn starch available from Amaizo Corporation as Instant Gelex.

First, the sodium tetraborate was added to the deionized water and stirred. Next, the boric acid was added to the solution and stirred until the sodium tetraborate and boric acid were completely dissolved. Separately, the detergent was added to the 3-iodo-2-propynyl butyl carbamate and the composition was stirred. The xylene, pine oil and defoamer were added to the composition and the composition was stirred until the 3-iodo-2-propynyl butyl carbamate was completely dissolved.

The solution of 3-iodo-2-propynyl butyl carbamate, xylene, pine oil and defoamer was then added to the solution of deionized water, sodium tetraborate and boric acid while stirring. Then, the thickener was added to the solution and the solution was stirred until homogeneous. Finally, to the resulting solution was added 3150 parts of a bleach containing 5.25 percent, by weight, of sodium hypochlorite.

The above composition was used to clean a portion of the dirty and badly mildewed exterior of a house that had been painted 2½ years previously with an alkyd oil-based exterior house paint. The composition was sprayed using a Hudson tank sprayer to a thickness of 6 mils. One portion of the composition was rinsed off with water after 10 minutes, the other portion was rinsed off after 15 minutes. The cleaned portions of the house did not show any evidence of dirt or mildew remaining on the surface of the paint.

EXAMPLE 2

A fungicidal detergent composition was prepared from the following components.

| Component | Grams |
|---|---|
| deionized water | 503.28 |
| polysaccharide thickener[1] | 7.00 |
| magnesium chloride | 1.00 |
| sodium salt of ethylene diamine tetracetic acid | 5.00 |
| $C_9$–$C_{11}$ linear primary alcohol ethoxylate[2] | 20.00 |
| 3-iodo-2-propynyl butyl carbamate[2] | 2.00 |
| anhydrous sodium metasilicate | 8.60 |

[1]available as Gelrite TM from Kelco Div. of Merck Co., Inc.
[2]as in Example 1.

The sodium metasilicate and 4.25 grams of the sodium salt of ethylene diamine tetracetic acid were mixed together and then added to a separate mixture of the remaining components. A solution of 300 grams of water and 150 grams of a bleach containing 5.25 percent, by weight, of sodium hypochlorite was added to the above mixture.

The extensively mildewed surface of a solvent based exterior house paint-coated fir wood panel was sprayed with the above detergent composition. The panel was rinsed well with water after the detergent composition had been in contact with the surface of the panel for 20 minutes. After one month on exposure in Texas at 45° south, the panel did not show any evidence of mildew regrowth. After two months exposure, panel showed very little mildew regrowth.

The above composition was used to clean a portion of the exterior of a garage that had been painted 2 years previously with a latex exterior house paint and that, prior to cleaning, had a great deal of mildew and algae growth. The composition was sprayed using a garden sprayer to a thickness of 6 mils. The composition was rinsed off with water after 20 minutes. The cleaned portion of the garage did not show evidence of dirt or mildew remaining on the surface of the paint. After 3½ months, the cleaned portion of the garage, examined using a hand held microscope at 40X, did not show any evidence of mildew or algae growth.

EXAMPLE 3

A fungicidal detergent composition was prepared from the following components:

| Component | Grams |
|---|---|
| deionized water | 507.4 |
| polysaccharide thickener[1] | 7.0 |
| sodium ethylene diamine tetracetate | 5.0 |
| $C_9$–$C_{11}$ linear primary alcohol ethoxylate[1] | 20.0 |
| 3-iodo-2-propynyl butyl carbamate[3] | 2.0 |
| anhydrous sodium metasilicate | 8.6 |

[1]As in Example 1.

A mixture of three hundred grams of water and 150 grams of a bleach containing 5.25 percent, by weight of sodium hypochlorite was added to a mixture of 478,0 grams of the deionized water, the thickener, 0.75 grams of sodium ethylene diamine tetracetate, the ethoxylate and the carbamate. Next, to the resulting mixture was added a mixture of the remaining components.

A panel was prepared as described in Example 2 using the fungicidal detergent composition of Example 3. Immediately after being cleaned, the panel was viewed under a light microscope at 40x and mold was not found to be present on the surface of the panel.

EXAMPLE 4

A fungicidal detergent composition was prepared from the following components

| Component | Grams |
|---|---|
| xylene | 6.0 |
| octylphenoxypoly(ethyleneoxy) ethanol[1] | 2.4 |
| 3-iodo-2-propynyl butyl carbamate[2] | 2.0 |
| nonionic polyether polyurethane associative thickener[3] | 79.0 |
| sodium ethylene diamine tetracetate | 5.0 |
| sodium metasilicate | 20.0 |
| sodium 2-ethylhexyl sulfate[4] | 4.0 |
| deionized water | 131.6 |

[1]Available from Rohm & Haas Co. as Triton X-100.
[2]As in Example 1.
[3]Available from Union Carbide Co. as SCT-270.
[4]Available from Witco Chemical Corp., Organics Division as Witcolate D510.

The xylene and octylphenoxypoly(ethyleneoxy) ethanol were mixed together. Next, the 3–iodo-2–propynyl butyl carbamate was added to the mixture. Thereafter, the remaining components were added to the mixture. Next, a mixture of 600 grams of water and 150 grams of a bleach containing 5.25 percent, by weight, of sodium hypochlorite was added to the mixture.

A panel was prepared as described in Example 2 using the fungicidal detergent composition of Example 4. Immediately after being cleaned, the panel was then under a light microscope at 40x and mold was not found to be present on the surface of the panel.

EXAMPLE 5

Fungicidal detergent compositions were prepared from the following components. Compositions 5A, 5B, 5C, and 5D represent compositions of the invention. Compositions 5E and 5F are comparative compositions.

| Component | 5A | 5B | 5C | 5D | 5E | 5F |
|---|---|---|---|---|---|---|
| | Parts by Weight | | | | | |
| 3-iodo-2-propynyl butyl carbamate[1] | 2 | 2 | 2 | 2 | 2 | — |
| xylene | 24.4 | — | 24.4 | 24.4 | 24.4 | — |
| nonylphenoxy poly(ethyleneoxy) ethanol[2] | 2 | 2 | 2 | 2 | 2 | 2 |
| octylphenoxy poly(ethyleneoxy) ethanol[3] | 24 | 24 | 24 | 24 | 24 | 24 |
| heteropolysaccharide thickener[4] | 7 | 7 | — | — | — | 7 |
| heteropolysaccharide thickener[5] | — | — | 7 | — | — | — |
| nonionic polyether polyurethane associative thickener[3] | — | — | — | 80 | — | — |
| deionized water | 350 | 350 | 350 | 277 | 357 | 350 |
| anhydrous sodium metasilicate | 8.6 | 8.6 | 8.6 | 8.6 | 8.6 | 8.6 |
| sodium salt of ethylene diamine tetracetic acid | 5 | 5 | 5 | 5 | 5 | 5 |

[1]As in Example 1.
[2]Available as Igepal CO210 from the Chemical Products Division of GAF Corp.
[3]As in Example 4.
[4]Available as K1A112 from Kelco Div. of Merck Co., Inc.
[5]Available as K9C57 from Kelco Div. of Merck Co., Inc..

Each of the above formulations except 5F was mixed with deionized water and household bleach before using. The solutions used to clean mildewed boards contained 0.2 percent by weight of 3-iodo-2-propynyl butyl carbamate and 15 percent by weight of household bleach. Composition 5F does not contain the carbamate but has 15 percent by weight of household bleach.

The extensively mildewed surfaces of a solvent-based exterior house paint coated fir panels were washed using one of the above compositions so that three panels were washed with each composition. Three ccomparison panels were washed with Jomax® detergent composition prepared as in Example 2. The panels were rinsed after either 10, 20 or 30 minutes. After 2 months and 7 months exterior exposure in Texas at 45° north, the panels were evaluated on a scale of 0 (total regrowth) to 10 (no growth) according to ASTM D3274–70 to indicate the extent of mildew regrowth. Immediately after being washed, all of the panels had a mildew regrowth rating of 10. The results are shown in Table I.

TABLE I

| Minutes before rinsing detergent | Mildew Regrowth Rating | | | | | |
|---|---|---|---|---|---|---|
| | Panels after 2 months | | | Panels after 7 months | | |
| Composition of | 10 | 20 | 30 | 10 | 20 | 30 |
| 5A | 9 | 10 | 10 | 6+ | 6 | 6+ |
| 5B | 8+ | 9 | 9+ | 6+ | 6+ | 6+ |
| 5C | 9 | 9+ | 9+ | 6 | 6 | 6 |
| 5D | 9 | 9 | 9 | 6 | 6 | 6 |
| 5E | 6 | 6 | 6 | 3 | 3 | 3 |
| 5F | 6+ | 6+ | 6+ | 4 | 3+ | 3+ |

*The mildew growth was partially emanating from within coating.

After 1 year of the aforesaid exterior exposure, the panels were evaluated again on a scale of 0 (total regrowth) to 10 (no growth) according to ASTM D3274–70 to indicate the extent of mildew regrowth. The results are shown in Table II.

TABLE II

| Minutes before rinsing detergent | Mildew Regrowth Rating Panels after 1 year | | |
|---|---|---|---|
| Composition of | 10 | 20 | 30 |
| 5A | 6+ | 6 | 6+ |
| 5B | 6+ | 6+ | 6+ |
| 5C | 6+* | 6+* | 6+* |
| 5D | 6+* | 6* | 6+* |
| 5E | 2+* | 2+* | 2+* |
| 5F | 4* | 3* | 3* |

*The mildew growth was partially emanating from within coating.

Thus, the compositions of the invention prevented mildew regrowth longer than the same composition without the fungicide. Further, the composition without the thickener did not prevent mildew regrowth as well as the compositions with the thickener.

EXAMPLE 6

The detergent compositions of Examples 1 and 2 were evaluated for efficacy on ceramic tiles according to Hard Surface Mildew Fungistatic Test Method No. 24 of the Chemical Specialties Manufacturer's Association. The cleaned, innoculated tiles were incubated at 30° C. and 75% relative humidity. After 7 days, a tile that had been cleaned only with water had fungal growth covering 50 percent of the tile. The tile that had been cleaned with the compositions of Examples 1 and 2 did not have any fungal growth thereon.

What is claimed is:

1. A non-film forming, aqueous cleaning composition comprising:

(a) from 0.1 to 0.4 percent by weight of said composition of 3-iodo-2-propynyl butyl carbamate;

(b) from 1.0 to 6.0 percent by weight of said composition of a detergent;

(c) a thickener present at a level sufficient that said composition has a viscosity at 25 degrees C. of between about 200 and about 4,000 centipoise;

(d) an oxidizing agent which can provide an amount of chlorine to said composition, calculated as elemental C1, in a range of from 0.17 to 0.50 percent by weight of said composition; and (e) water.

2. The composition of claim 1 wherein said thickener is present at a level sufficient that said composition has a viscosity at 25 degrees C. of between about 350 and about 950 centipoise.

3. The composition of claim 1 having a pH in a range of from about 4.0 to about 8.5 prior to incorporation of said oxidizing agent.

4. The composition of claim 1 wherein said thickener is present at a level sufficient that said composition has a viscosity at 25 degrees C. of between about 350 and about 950 centipoise, and said composition prior to incorporation of said oxidizing agent has a pH in a range of from 6.0 to 8.5.

5. The composition of claim 1 wherein said composition is in the form of a two package composition in which said oxidizing agent and at least a portion of said water are in one package, and said fungicide, algicide and mixtures thereof, said detergent, said thickener, and a portion of said water are in another package.

6. A process for cleaning and for killing and inhibiting the regrowth of fungi and algae on a solid surface comprising:

(1) applying to a solid surface a non-film forming, aqueous composition comprising (a) from 0.1 to 0.4 percent by weight of said composition of 3- iodo-2-propynyl butyl carbamate,

(b) from 1.0 to 6.0 percent by weight of said composition of a detergent, (c) a thickener present at a level sufficient that said composition has a viscosity at 25 degrees C. of between about 200 and about 4,000 centipoise;

(d) an oxidizing agent which can provide an amount of chlorine to said composition calculated as elemental C1 in a range of from 0.17 to 0.50 percent by weight of said composition, and (e) water;

(2) allowing said composition to remain in contact with said surface for a time sufficient to at least partially clean said surface; and (3) rinsing said composition from said surface.

7. The process of claim 6 wherein said composition has a pH in a range of from about 4.0 to about 8.5 prior to incorporation of said oxidizing agent.

8. The process of claim 6 wherein said thickener is present at a level sufficient that said composition has a viscosity at 25 degrees C. of between about 350 and about 950 centipoise, and said composition prior to incorporation of said oxidizing agent has a pH in a range of from 6.0 to 8.5.

9. The process of claim 6 wherein said composition is in the form of a two package composition in which said oxidizing agent and at least a portion of said water are in one package; and said fungicide, algicide and mixtures thereof, said detergent, said thickener, and a portion of said water are in another package.

10. The process of claim 6 wherein said surface is an organic film.

* * * * *